United States Patent [19]

Vobach

[11] Patent Number: 4,674,297

[45] Date of Patent: Jun. 23, 1987

[54] CHEMICALLY ASSISTED MECHANICAL REFRIGERATION PROCESS

[76] Inventor: Arnold R. Vobach, 6006 Allentown Dr., Spring, Tex. 77379

[21] Appl. No.: 829,429

[22] Filed: Feb. 13, 1984

Related U.S. Application Data

[63] Continuation-in-part of Ser. No. 537,724, Sep. 29, 1983, abandoned, which is a continuation-in-part of Ser. No. 363,011, Mar. 29, 1982, abandoned.

[51] Int. Cl.[4] ..... F25B 15/00

[52] U.S. Cl. ..... 62/476; 62/502

[58] Field of Search ..... 62/476, 117, 335, 525, 62/502, 114

[56] References Cited

U.S. PATENT DOCUMENTS

| | | | |
|---|---|---|---|
| Re. 30,252 | 4/1980 | Leonard | 62/84 |
| 1,675,455 | 7/1928 | Haynes | 62/84 |
| 2,182,453 | 12/1939 | Sellew | 62/119 |
| 2,307,380 | 1/1943 | Bailer | 62/101 |

FOREIGN PATENT DOCUMENTS

| | | | |
|---|---|---|---|
| 0021205 | 6/1980 | European Pat. Off. . | |
| 0056147 | 12/1981 | European Pat. Off. | 62/114 |
| 485656 | 11/1929 | Fed. Rep. of Germany | 62/114 |
| 593548 | 1/1932 | Fed. Rep. of Germany | 62/114 |
| 953378 | 11/1956 | Fed. Rep. of Germany | 62/114 |
| 2801529 | 7/1979 | Fed. Rep. of Germany | 62/114 |
| 2850403 | 5/1980 | Fed. Rep. of Germany | 62/114 |
| 3100019 | 9/1982 | Fed. Rep. of Germany | 62/114 |
| 3204460 | 8/1983 | Fed. Rep. of Germany | 62/114 |
| 2308885 | 4/1976 | France | 62/114 |
| 2044907 | 3/1979 | United Kingdom | 62/114 |

*Primary Examiner*—Henry Bennett

*Attorney, Agent, or Firm*—Arnold, White & Durkee

[57] ABSTRACT

There is provided a chemically assisted mechanical refrigeration process including the steps of: mechanically compressing a refrigerant stream which includes vaporized refrigerant; contacting the refrigerant with a solvent in a mixer (11) at a pressure sufficient to promote substantial dissolving of the refrigerant in the solvent in the mixer (11) to form a refrigerant-solvent solution while concurrently placing the solution in heat exchange relation with a working medium to transfer energy to the working medium, said refrigerant-solvent solution exhibiting a negative deviation from Raoult's Law; reducing the pressure over the refrigerant-solvent solution in an evaporator (10) to allow the refrigerant to vaporize and substantially separate from the solvent while concurrently placing he evolving refrigerant-solvent solution in heat exchange relation with a working medium to remove energy from the working medium to thereby form a refrigerant stream and a solvent stream; and passing the solvent and refrigerant stream from the evaporator.

8 Claims, 5 Drawing Figures

CHEMICALLY ASSISTED MECHANICAL REFRIGERATION PROCESS

The U.S. government has rights in this invention pursuant to Department of Energy Grant No. DE-FG-46-81R 612081.

This application is a continuation-in-part of application Ser. No. 537,724 filed Sept. 29, 1983 which is a continuation-in-part of application Ser. No. 363,011 filed Mar. 29, 1982 now abandoned.

BACKGROUND OF THE INVENTION

This invention relates generally to refrigeration and more particularly to a new and improved chemically assisted mechanical refrigeration cycle.

The typical mechanical refrigeration system employs a mechanical compressor to raise the pressure and to condense a gaseous refrigerant, which thereafter absorbs its heat of vaporization. Thus, the typical vapor compression cycle uses an evaporator in which a liquid refrigerant, such as Freon-12, boils at a low pressure to produce cooling; a compressor to raise the pressure of the gaseous refrigerant after it leaves the evaporator; a condenser, in which the refrigerant condenses and discharges its heat to the environment; and an expansion valve through which the liquid refrigerant leaving the condenser expands from the high-pressure level in the condenser to the low pressure level in the evaporator.

Much effort has been expended over the past few decades in developing refrigeration systems which utilize low grade energy sources, such as solar energy, without the need for compressors or pumps. Much of this effort has been directed to the so-called absorption cycle, which accomplishes compression by using a secondary fluid as a solvent to absorb a refrigerant gas. A typical absorption system includes a condenser, expansion valve and evaporator, as does the vapor compression cycle. However, the compressor is replaced by an absorber-generator pair. Lithium bromide-water or water-ammonia are typical of the solvent-refrigerant mixtures used.

The resorption cycle has also been studied. Introduced in the earlier half of this century, the resorption cycle is similar in operation to the absorption cycle. However, a resorber replaces the condenser and the vapor is absorbed by a special weak solution while condensing. This solution is then circulated to the evaporator where the refrigerant boils and the heats of disassociation and vaporization produce the refrigerating effect.

Although the majority of prior systems avoid the use of compressors when using a solvent-refrigerant combination, a few processes have employed a solvent-refrigerant pair with a compressor in the system. The system and method described in U.S. Pat. No. 4,037,426 is illustrative. There the gaseous refrigerant is compressed and then mixed with liquid solvent. Thereafter, the mixture is cooled in a heat exchanger and then passed to a decanter, where the heavier liquid fraction is separated from the lighter liquid refrigerant. The liquid refrigerant then passes to a zone of low pressure where it is vaporized to absorb heat from a working fluid. Systems or methods disclosed in U.S. Pat. Nos. 3,277,659 and 4,199,961 provide other examples of compressor type systems.

These and other prior systems suffer from one or more of several limitations. For example, prior systems fail to take advantage of both the heat of vaporization and the heat of dilution to ultimately cool a working medium in a compression type cycle. Additionally, prior systems utilizing a compressor require a heavy duty compressor capable of sustaining relatively high compression ratios. Other systems operate at comparatively high pressures which require heavier duty components. Still, other systems have relatively inefficient heat transfer mechanics. Yet other systems fail to allow auxiliary heat exchange between refrigerant-solvent and solvent without decreasing the density of the flow to the compressor while other systems fail to provide sensible heat transfer in an auxiliary heat exchange between refrigerant-solvent and solvent. Still other systems fail to provide secondary evolution of gaseous refrigerant from the solvent after the solvent leaves the evaporator to facilitate overall efficiency. These and other problems encountered by the prior systems are substantially reduced, if not eliminated, by the present invention.

SUMMARY OF THE INVENTION

There is provided a chemically assisted mechanical refrigeration process using a refrigerant and a solvent having a negative deviation from Raoult's Law when in combination with each other. A stream of solution including the solvent and a liquified refrigerant is passed to an evaporator. The pressure over the solution is then reduced to allow refrigerant to vaporize and separate from the solvent. Concurrently therewith, the evolving refrigerant and solvent are placed in heat exchange relation with a working medium to remove energy from the working medium. A solvent stream and a refrigerant stream including gaseous refrigerant are formed and leave the evaporator. Thereafter, the refrigerant stream undergoes mechanical compression and the refrigerant stream and solvent stream are contacted at a pressure sufficient to promote substantial dissolving of the refrigerant and the solvent. A stream of solution is thus formed for passage to the evaporator. As the refrigerant and solvent are in heat exchange relation with the working medium for at least a portion of the time they are in contact and mixing, energy is removed therefrom.

In one embodiment, the solvent stream leaving the evaporator is preferably passed in heat exchange relation with the solution stream passing to the evaporator. This occurs in an economizing zone so as to cause transfer of heat between the solvent stream and the solution stream.

Such heat transfer may be facilitated by the mass transfer of gaseous refrigerant in relation to one or more of the streams passing through the economizing zone. For example, in one embodiment the solvent stream leaving the evaporator includes a material portion of the dissolved refrigerant. The solvent stream is placed in fluid communication with the refrigerant stream leaving the evaporator to accomplish mass transfer of gaseous refrigerant from the solvent stream to the refrigerant stream. This in turn facilitates heat transfer in the economizing zone prior to passage of the solvent stream and refrigerant stream to the mixing zone.

In a modification of this embodiment, a mixing zone may be provided including a mixer and a joint compression or compressing zone. In the joint compression zone, the refrigerant and solvent stream are brought into contact with each other and the pressure on the refrigerant-solvent is raised sufficiently to facilitate dissolving of the refrigerant in the solvent in the mixer.

In another modification of this embodiment, a mixing zone may be provided, including a mixer, a liquid-pumping zone and a gas-compressing zone. In the liquid-pumping zone, the pressure on the liquid solvent stream is raised sufficiently to facilitate dissolving of the refrigerant in the solvent in the mixer. In the gas-compressing zone, the pressure on the gaseous refrigerant is likewise raised sufficiently to facilitate dissolving of the refrigerant in the solvent in the mixer. Furthermore, the solvent stream, either before or after passing through the pumping zone, is passed in heat exchange relationship, but not in fluid communication, with the refrigerant stream in the gas-compressing zone.

The heat exchange between the liquid solvent stream and the gaseous refrigerant stream in the gas-compressing zone may be accomplished by a solvent stream cooling jacket around any of the various compressors which may be used to compress the gaseous refrigerant.

Where the refrigerant and solvent streams leaving the evaporator are placed in fluid communication with each other to allow evolution of gases from the solvent stream, and the two streams thereafter pass to a joint compressing zone including a single compressor; the compressor may be a rotary compressor, centrifugal compressor or rotary screw compressor.

In still a further modification, refrigerant and solvent streams leaving the evaporator may be brought into contact in the compressing zone to form a combined solvent-refrigerant stream. The solvent-refrigerant stream leaving the compressing zone and passing to the mixer may then be placed in heat exchange relation with the stream of solution leaving the mixer prior to passage of the stream of solution to the economizing zone. It is believed that the temperature of the combined solvent-refrigerant stream preferably approaches the temperature of the mixer just prior to entering the mixer.

In another embodiment the mass transfer of gaseous refrigerant is accomplished by passing a portion of the refrigerant stream leaving the compression zone to the stream of solution in the economizing zone, whereby the percentage of refrigerant in the solution stream is increased.

In a more detailed embodiment, there may be provided a chemically assisted mechanical refrigeration process including several steps. A stream of solution including a solvent and a liquified refrigerant is passed to an evaporator. The refrigerant and solvent have a negative deviation from Raoult's Law when in combination. The pressure is then reduced over the solution to allow refrigerant to vaporize and separate from the solvent while concurrently therewith the evolving refrigerant and solvent are put in heat exchange relation with a working medium to remove energy from the working medium and thereby form a solvent stream and a refrigerant stream leaving the evaporator. The refrigerant stream includes gaseous refrigerant. The solvent stream leaving the evaporator is then passed in heat exchange relation with the solution stream passing to the evaporator in an economizing zone so as to cause transfer of heat between the solvent stream and the solution. Concurrently therewith, the solvent and refrigerant streams are put in fluid communication with each other so as to accomplish mass transfer of gaseous refrigerant from the solvent stream to the refrigerant stream and so facilitate heat transfer in the economizing zone between the solvent and solution streams. The solvent and refrigerant streams are subsequently contacted in a joint compressing zone where the pressure over both streams is raised to form a combined solvent-refrigerant stream. The combined solvent-refrigerant stream is then passed to a mixer under a pressure sufficient to promote substantial dissolving of the refrigerant in the solvent to form the stream of solution for passage to the evaporator. As the mixer is in heat exchange relation with a working medium, energy is removed from the mixer.

In another more detailed embodiment, there may be provided a chemically assisted mechanical refrigeration process including several steps. A stream of solution including a solvent and a liquified refrigerant is passed to an evaporator. The refrigerant and solvent have a negative deviation from Raoult's Law when in combination. The pressure is then reduced over the solution to allow refrigerant to vaporize and separate from the solvent while concurrently therewith the evolving refrigerant and solvent are put in heat exchange relation with a working medium to remove energy from the working medium and thereby form a solvent stream and a refrigerant stream leaving the evaporator. The refrigerant stream includes gaseous refrigerant. The solvent stream leaving the evaporator is then passed in heat exchange relation with the solution stream passing to the evaporator in an economizing zone so as to cause transfer of heat between the solvent stream and the solution. Concurrently therewith, the solvent and refrigerant streams are put in fluid communication with each other so as to accomplish mass transfer of gaseous refrigerant from the solvent stream to the refrigerant stream and so facilitate heat transfer in the economizing zone between the solvent and solution streams. The solvent and refrigerant streams are subsequently separately pressurized in liquid-pumping and gas-compressing zones, with the solvent stream being put into heat exchange relation, but not in contact, with the refrigerant in the gas-compressing zone. The solvent and refrigerant streams are then passed to a mixer under a common pressure sufficient to promote substantial dissolving of the refrigerant in the solvent to form the stream of solution for passage to the evaporator. As the mixer is in heat exchange relation with a working medium, energy is removed from the mixer.

Furthermore, in a still more detailed embodiment of the one described immediately above, that portion of the solvent stream passing from the evaporator to the mixer may be put in heat exchange relation, either before or after passage through the liquid-pumping zone, with the solution stream passing from the mixer to the said economizing zone.

In another embodiment, the vaporized refrigerant may be compressed by passing a high velocity liquid jet of solvent into the refrigerant. A portion of the refrigerant may also be passed to a generator-absorber pair prior to entering the mixer.

There is also provided in accordance with the present invention a chemically assisted mechanical refrigeration apparatus including a mechanical compressor for compressing a refrigerant and a mixing zone including a mixer for receiving a solvent and the compressed refrigerant at a pressure sufficient to promote substantial solution of the refrigerant in the solvent and form a solvent-refrigerant stream. There is also provided an evaporator zone including or consisting of an evaporator for receiving the refrigerant-solvent stream from the mixer and ultimately returning the refrigerant to the mixer after allowing at least a substantial portion of the refrigerant to separate from the solvent and absorb heats of vaporization and dissolution from a working medium, which medium is in heat exchange relation with the evolving refrigerant-solvent.

There may also be provided an economizing zone for placing the solvent passing from the evaporator zone to the mixing zone in heat exchange relation with the refrigerant-solvent stream passing from the mixer to the evaporator zone. For example, a heat exchanger including a conduit for passage of solvent and a surface adjacent to the conduit for receiving a thin film of solvent-refrigerant may be provided. There may also be provided an injection mechanism for passing a portion of the compressed refrigerant directly into solution with the refrigerant-solvent stream after the mixture passes from the mixer as well as a heat exchanger for placing the refrigerant-solvent stream leaving the mixer in heat exchange relation with the solvent or both compressed refrigerant and solvent entering the mixer.

Coils may be substantially immersed in liquid in the evaporator for circulating the working medium or the evaporator may comprise a shell and tube heat exchanger arrangement. In some embodiments, the mechanical compressor may be a jet compressor adapted to use solvent from the evaporator to compress the refrigerant leaving the evaporator.

In a more detailed embodiment, there may be provided a chemically assisted mechanical refrigeration apparatus including an evaporator zone for receiving a refrigerant-solvent stream at a pressure sufficient to allow the refrigerant to separate from the solvent and absorb a substantial portion of the heats of vaporization and dissolution of the solvent-refrigerant stream from a working medium which is in heat exchange relation with the evolving refrigerant-solvent combination. A compressor is provided and adapted to accept a gaseous stream and a liquid stream and raise the pressure of said streams upon combination. A solvent conduit connects the evaporator and the compressor to allow passage of solvent from the evaporator to the compressor. A refrigerant conduit connects the evaporator and the compressor for passage of a gaseous refrigerant from the evaporator to the compressor. The refrigerant conduit is in fluid communication with the solvent conduit such that the refrigerant conduit may receive gases evolving from the solvent passing through the solvent conduit. A solution conduit having one end connected to the mixer and the other end connected to the evaporator is also provided. The solution conduit is adapted to facilitate any reduction in pressure between the mixer and the evaporator. An economizer is also provided for placing the solvent conduit and the solution conduit in heat exchange relation with each other.

In any case where refrigerant and solvent are contacted in the compressor, the compressor may be a rotary compressor, centrifugal compressor or rotary screw compressor.

In another more detailed embodiment, there may be provided a chemically assisted mechanical refrigeration apparatus including an evaporator zone for receiving a refrigerant-solvent stream at a pressure sufficient to allow the refrigerant to separate from the solvent and absorb a substantial portion of the heats of vaporization and of dissolution of the solvent-refrigerant stream from a working medium which is in heat exchange relation with the evolving refrigerant-solvent combination. A compressor and a pump are provided and adapted to accept a gaseous stream and a liquid stream, respectively, and to raise the pressures of said streams. A first solvent conduit connects the evaporator and the pump to allow passage of solvent from the evaporator to the pump. This first solvent conduit is adapted to permit heat exchange between the solvent stream and the gaseous refrigerant stream in the compressor. A first refrigerant conduit connects the evaporator and the compressor for passage of a gaseous refrigerant from the evaporator to the compressor. This first refrigerant conduit is in fluid communication with said first solvent conduit such that this first refrigerant conduit may receive gases evolving from the solvent passing through said first solvent conduit. Second refrigerant and solvent conduits conduct the refrigerant and solvent streams from compressor and pump, respectively, to the mixer. A solution conduit having one end connected to the mixer and the other end connected to the evaporator is also provided. The solution conduit is adapted to facilitate any reduction in pressure between the mixer and the evaporator. An economizer is also provided for placing said first solvent conduit and the solution conduit in heat exchange relation with each other.

Another more detailed embodiment differs from the one immediately preceding only in that the first solvent conduit between evaporator and pump is not adapted for heat exchange at the compressor, whereas the second solvent conduit connecting the pump and the mixer is adapted for heat exchange relationship with the solution conduit.

In all such cases where refrigerant and solvent are contacted in the compressor, the compressor may be a rotary compressor, centrifugal compressor or screw compressor.

Various embodiments will now be described by way of example with respect to the drawings.

There follows a detailed description of certain embodiments of the present invention, including those presently preferred, in conjunction with the foregoing drawings. This description is to be taken by way of illustration rather than limitation.

DETAILED DESCRIPTION

Figure 1:
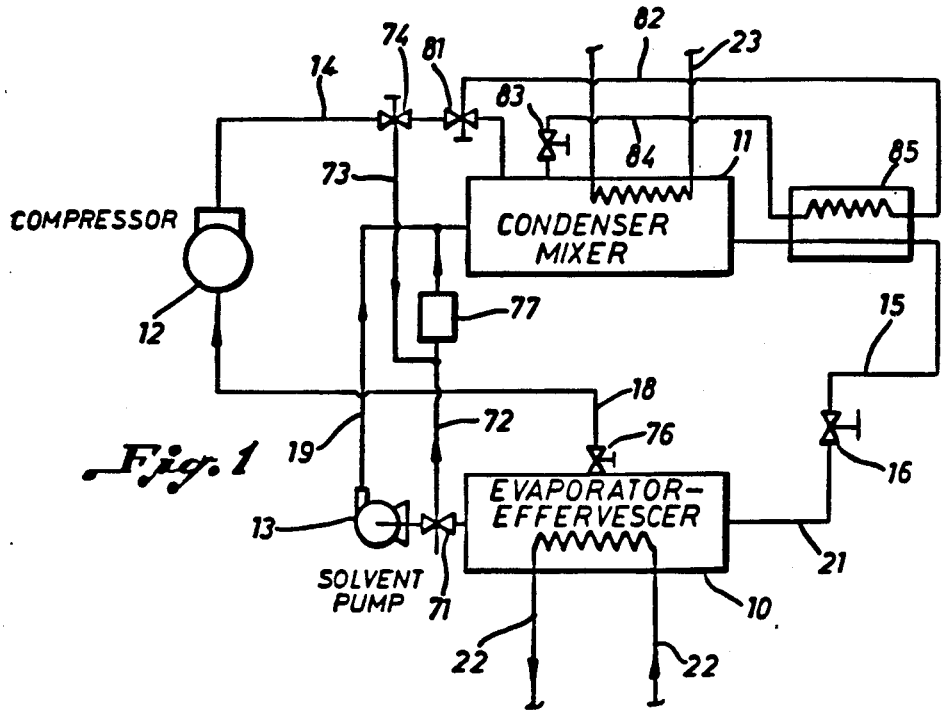
FIG. 1 is a schematic view of a chemically assisted mechanical refrigeration cycle.

Referring now to FIG. 1, there is shown a schematic view of a chemically assisted mechanical refrigeration cycle. An appropriate solvent-refrigerant stream preferably having the refrigerant totally in solution is introduced into evaporator 10 from line 21. As will hereinafter be more fully described, refrigerant vaporizes and separates from solvent under the operating conditions in the evaporator 10, such that heats of dissolution and vaporization are transferred from a working medium, such as water, circulating in conduit 22. A solvent stream leaves as a liquid and is pumped by solvent pump 13 via line 19 to mixer-condenser 11, while a refrigerant stream of vaporized refrigerant leaves the evaporator via line 18 and through normally open valve 76 to be compressed in compressor 12 before being transferred to mixer 11 via line 14. Valves 71 and 74 are operated to prevent any flow from occurring in lines 72 and 73, respectively. Similarly, valve 81 prevents flow through line 82.

At the operating conditions of the mixer 11 the now compressed refrigerant is dissolved into the solvent entering the mixer from line 19. Heats of mixing and condensation are withdrawn from the condenser-mixer 11 via a working medium in line 23. There is thus formed a solvent-refrigerant stream.

The solvent-refrigerant stream passes via line 15 through expansion valve 16 where it is reduced in pressure before entering evaporator 10 via line 21.

The evaporator-effervescer 10 is so constructed as to allow substantial transfer of both the heat of vaporization and the heat of disassociation from the working fluid circulating through line 22. As efficient heat transfer is promoted through the use of a wetted heat transfer surface, the heat transfer surface may preferably be wetted by the solvent with or without dissolved refrigerant. Thus, in one embodiment the refrigerant-solvent stream may be passed as a thin film over a heat transfer surface with embedded coils containing the working fluid.

Figure 3:
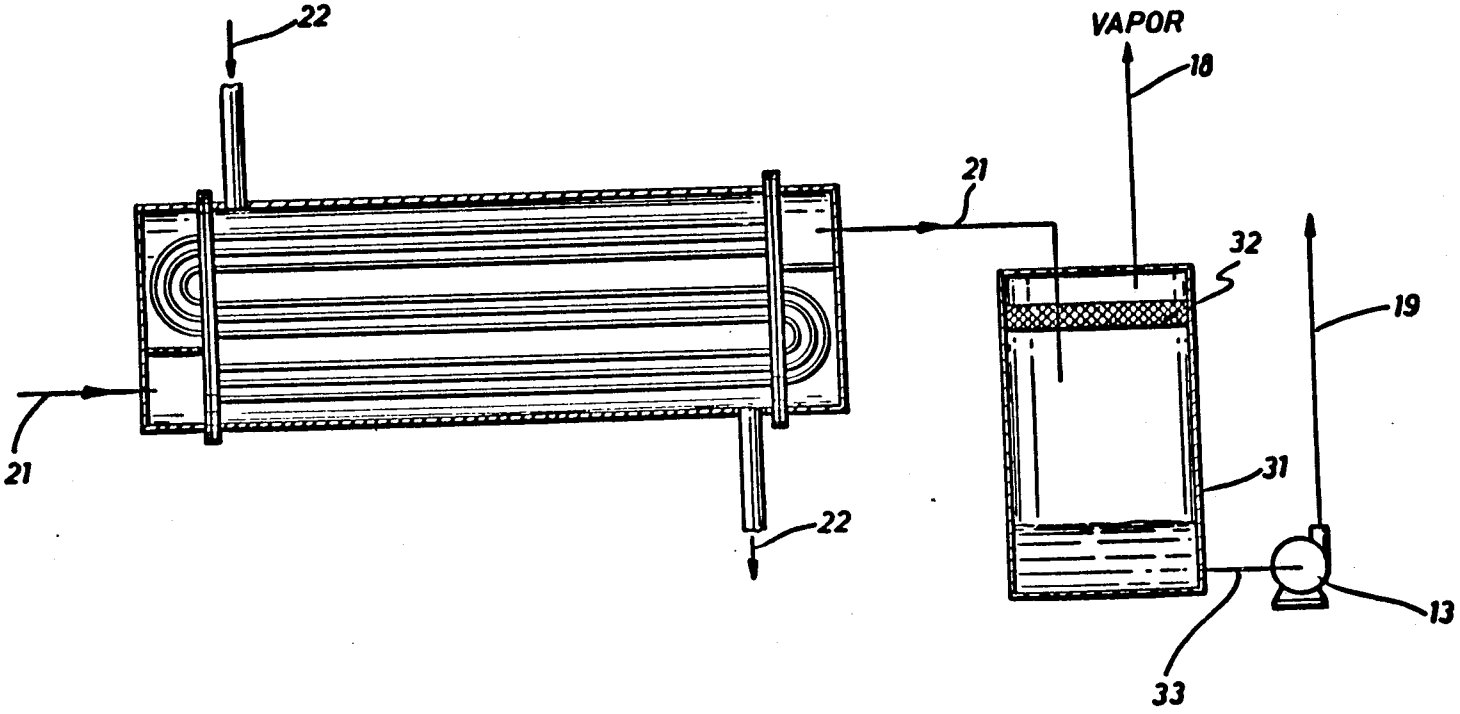
FIG. 3 is a schematic view of an evaporator for use in the embodiments shown in FIGS. 1, 2 and 4.

In another embodiment shown in FIG. 3 a working fluid, such as chilled water, is passed via line 22 through the shell side of a shell and tube type heat exchanger while the refrigerant-solvent stream entering from line 21 passes through the tube side. The refrigerant separates from the solvent in the tubes and both solvent and refrigerant pass to a liquid-vapor separator 31 where the solvent and refrigerant are separated. The liquid-vapor separator 31 may be equipped with a wire mesh 32 to catch entrained droplets which collect below wire mesh 32. The solvent passes via line 33 to pump 13 while the refrigerant passes via line 18 to compressor 12.

In another embodiment, the conduit 22 is substantially immersed in liquid in the evaporator. As the refrigerant-solvent stream enters the evaporator the refrigerant substantially disassociates and boils off from the solvent, thus cooling the working fluid. In such an embodiment the evaporator may be similar in construction to a shell and tube heat exchanger wherein the working medium circulates through the tubes, which are substantially immersed in liquid.

Alternatively, the working medium may pass through a coil, which passes through the lower portion of the evaporator and so is substantially immersed in liquid. By way of example, the refrigerant-solvent stream may circulate and undergo separation in a single-tube coil of ½' diameter for a one to four ton apparatus and then further separate in a liquid-vapor separator.

As would be known to one skilled in the art having the benefit of this disclosure, the evaporator may comprise any one of several modified heat exchangers or evaporators.

Where it is desirable to facilitate the separation of the vaporized refrigerant from solvent an eliminator may be employed at the vapor outlet of the evaporator if the vapor and liquid separate into two streams in the evaporator. This may be particularly appropriate when the refrigerant is passed separately from the solvent to a mechanical compressor.

The compressor may be any one of several mechanical types. Regardless of the type of compressor used, in keeping with the spirit of the present invention, its operating cost should generally be less than that of its counterpart in a typical vapor compression refrigeration system for a given application. This is possible due to the increased efficiency of the present system. This increased efficiency over prior mechanical vapor compression cycles is believed to result in part from the fact that the solubility of the refrigerant in the solvent reduces the level of required mechanical compression. The refrigerant need only be pressurized sufficiently to dissolve in the solvent in the condenser at the given operating conditions and concentrations. There is believed to be little or no wasted compression of the refrigerant to pressurize it sufficiently to condense at the condenser temperature as in the usual vapor compression cycle. Additionally, since the refrigerant is at a lower temperature as it leaves the mixer than in the case of a pure refrigerant cycle, less heat transfer is required and hence less working fluid need be circulated to the mixer.

Figure 2:
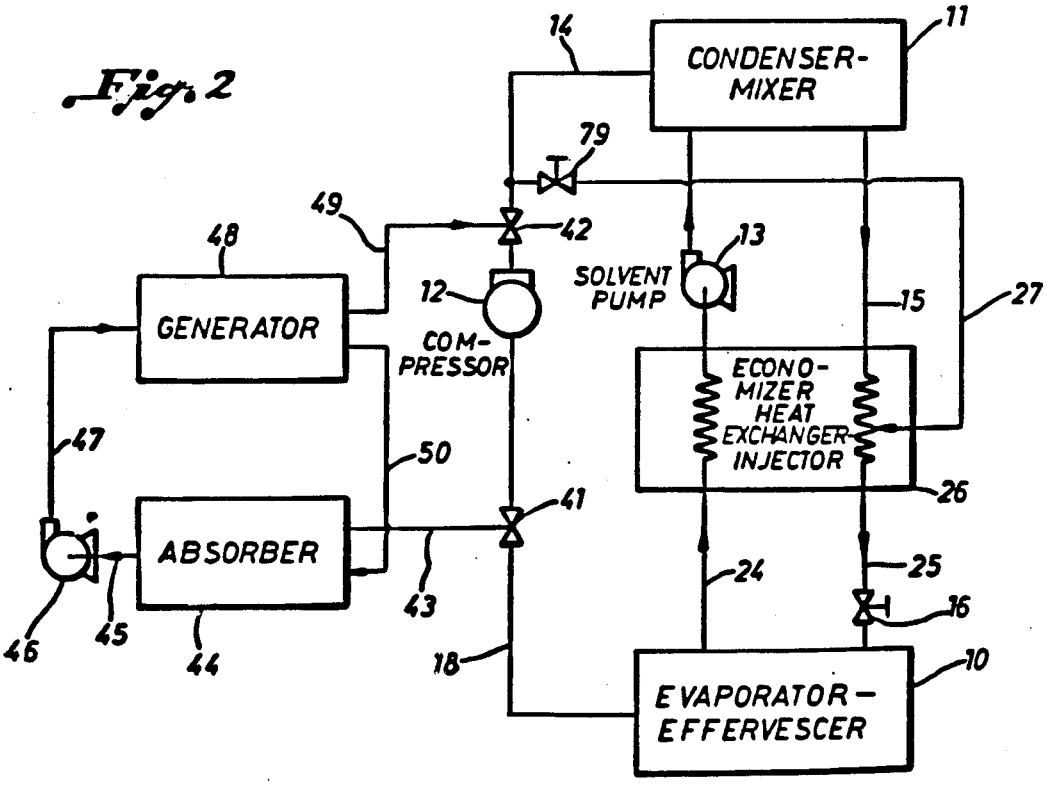
FIG. 2 is a schematic view of another embodiment of the chemically assisted mechanical refrigeration cycle.

The compressor chosen may vary with operating conditions, the refrigerant-solvent combination chosen or the application to which the system is applied. For example, for the embodiments shown in FIGS. 1 and 2, a centrifugal, rotary or screw compressor may be preferred since the gas refrigerant passing through line 18 may still have some entrained liquid despite the use of an eliminator at the outlet of the evaporator 10. Alternately, for the embodiment shown in FIG. 4 where the refrigerant and solvent streams leaving the evaporator are placed in fluid communication with each other to allow evolution of gases from the solvent stream, and the two streams thereafter pass to a single compressor, the compressor may be a rotary compressor, centrifugal compressor or rotary screw compressor.

Where a solvent pump is to be used, as for example in the embodiments set out in FIGS. 1 and 2, the solvent pump 13 may be any type suitable to pump the liquid solvent to the mixer under the operating conditions of the system. A centrifugal pump may be preferred due to its simplicity, low first cost, uniform nonpulsating flow, low maintenance expense, quiet operation and adaptability to use with either a motor or a turbine drive. On the other hand, a positive displacement pump such as a rotary, screw or gear pump may be preferred.

Keeping in mind the difference in pressure between the evaporator 10 and the mixer 11, the mixer may be of a design similar to that of the evaporator, such that the system may serve as a heater as well as a refrigerator.

The refrigerant-solvent combination comprises at least two constituents—a refrigerant and a solvent. The refrigerant and solvent are chosen such that the refrigerant will separate as a gas from the solvent under the operating conditions in the evaporator while preferably absorbing substantial amounts of the heats of demixing, dilution, or disassociation as well as vaporization. Thus, a governing principle for the selection of a refrigerant-solvent combination is that the refrigerant be highly soluble in the solvent, such that the pair exhibits negative deviations from Raoult's Law.

Examples of refrigerants which are believed to be suitable for use in the present invention with appropriate solvents include hydrocarbons such as methane, ethane, ethylene and propane; halogenated hydrocarbons, such as refrigerants R20, R21, R22, R23, R30, R32, R40, R41, R161 and R1132a; amines, including methylamine, or gases used in certain refrigeration processes such as methyl chloride, sulfur dioxide, ammonia, carbon monoxide and carbon dioxide or any appropriate combinations of these.

The solvent constituent should be a substantially non-volatile liquid at the operating conditions of the cycle or be at least such when in solution with a portion of the refrigerant. Thus, the solvent, for example, nitrous oxide, can be a gas at room temperature.

It is believed that the solvent may be an ether, an ester, an amide, an amine or polymeric derivatives of these, for example, dimethyl formamide and dimethyl ether of tetraethylene glycol as well as halogenated hydrocarbons, such as carbon tetrachloride and dichlorethylene; or appropriate combinations of these. A halogenated salt such as lithium bromide may also be a constituent of the solvent.

Also believed to be suitable as solvents are methanol, ethanol, acetone, chloroform and trichloroethane. Organic physical solvents such as propylene carbonate and sulfolane or other organic liquids containing combined oxygen may be used.

Relatively large deviations from Raoult's Law and hence relatively large heats of mixing are obtained when one, or preferably both, of the refrigerant and solvent molecules is polar. The excess solubility is believed to be a consequence of either dipole-dipole attraction (including hydrogen bonding) or induced dipole-dipole attraction.

Alternatively, limited experimental data and calculations indicate that certain combinations of refrigerant and solvent may not have a satisfactory coefficient of performance. Thus, calculations on the embodiment shown in FIG. 4 indicate that a combination of carbon dioxide and 1,1,1-trichloroethane may not be very efficient. More particularly, calculations generally paralleling those set out below with respect to 1,1,1-trichloroethane and R22 with respect to FIG. 4 resulted in a coefficient of performance of 1.83 for assumed evaporator and mixer temperatures of 5° F. (−15.00° C.) and 86° F. (30.00° C.), respectively, and 1.49 for assumed evaporator and mixer temperatures of 40° F. (4.44° C.) and 110 ° F. (43.33° C.). This may possibly be explained by the high critical temperatures and pressures of carbon dioxide of 87.87° F. (31.04° C.) and 1069.96 psia (7,377.11 kPa absolute), respectively.

It is believed that other chemical constituents may be added to the basic pair for other purposes, including foaming, lubrication, inhibition of corrosion, lowering of the freezing point, raising of the boiling point or indication of leaks. However, such added constituents should preferably be chosen so as not substantially to detract from the heat of disassociation or vaporization produced in the evaporator. Further, the constituents are preferably such as to not detract from any negative deviations from Raoult's Law.

The comparative efficiency of the instant invention is illustrated by reference to available data for a refrigerant-solvent pair comprising $CHClF_2$ (refrigerant 22) and dimethyl formamide (DMF). According to an enthalpy-concentration diagram disclosed in Jelinek, M., et al, *Enthalpy, - Concentration Diagram*—A.S.H.-R.A.E. Trans., 84 (1978), Pt. II, pp. 60–67, herein incorporated by reference, an R22-DMF solution is in equilibrium at 56.8 psig (391.62 kPa gage) and 86° F. (30.00° C.) with a weight distribution of 60% $R_{22}$ and 40% DMF. If pressure is reduced sufficiently, the $R_{22}$ will boil out of the DMF, absorbing a combined heat of vaporization and heat of mixing of slightly more than 72 Btu/lb (167.36 J per kg). Alternatively, the heat of mixing can be calculated from Equation (14) in Tyagi, K. P., *Heat of Mixing*—, Ind. Jnl. of Tech., 14 (1976), pp. 167–169, herein incorporated by reference, to be 19.33 Btu/lb. (44.93 J per kg), while the heat of vaporization of the $R_{22}$ is 55.92 Btu/lb. (129.98 J per kg) of solution. Thus, the total heat absorbed per pound of solution entering the evaporator is 75.25 Btu/lb. (174.91 J per kg), in close agreement with the enthalpy-concentration diagram mentioned above.

Although it may be preferable that the refrigerant-solvent mixture or combination be chosen such that a substantial amount of refrigerant vaporizes from solution in the evaporator, this need not always be the case. For example, a refrigerant with a comparatively high heat of vaporization may be circulated in small proportions relative to the amount of solvent when the refrigerant-solvent leaving the mixer is placed in heat exchange relation with the solvent leaving the evaporator, as shall hereinafter be more fully described in conjunction with FIG. 2.

In an alternative embodiment, the solvent leaving the evaporator can be passed through an economizer or auxiliary heat exchanger. Unlike many prior systems, such as described in U.S. Pat. No. 3,277,659 issued to Sylvan, there is no need to directly heat the suction vapor passing to the compressor, thus reducing its density and increasing the volume of gas handled by the compressor.

One form of this embodiment is illustrated in FIG. 2. The operation of this embodiment is similar to that of the embodiment shown in FIG. 1. However, an economizer 26, which may be similar to a Baudelot cooler, is employed. Additionally, lines 43 and 49 will usually be closed lines 43 and 49 unless the compressor is to be assisted by the absorber-generator pair as shall hereinafter be more fully described.

The refrigerant-solvent solution flows downward in a film over surfaces in the economizer-heat exchanger 26. These surfaces are chilled by cold solvent returning through conduit 24 from the evaporator-effervescer 10. The cooling cascading refrigerant-solvent may also be bathed in the atmosphere of still cool refrigerant bled by valve 79 from the compressor outlet through conduit 27. Consequently, the heat of condensation as well as the heat of mixing of additional refrigerant absorbed by the cooled refrigerant-solvent stream is transferred to the cold solvent circulating through the economizer. Alternatively, valve 79 may be closed and exchanger 26 operated only as a heat exchanger without any mixing occurring therein.

In operation the compressor 12 pumps and compresses the refrigerant gas and pumps the compressed gas through conduit 14, while valve 79 is opened and another portion of the compressed gas is pumped through conduit 27. The compressed gas going to the mixer 11 is mixed with the solvent and the refrigerant-solvent stream is directed through conduit 15 to the economizer 26 and expansion valve 16. The refrigerant-solvent is then directed to the evaporator 10 as in FIG. 1. The solvent from the evaporator is conducted via conduit 24 to the economizer 26 by the solvent pump 13 for recycling through the system. The compressor 12 draws or sucks vaporized refrigerant through conduit 18 to complete the cycle. The efficiency of the process may thus be enhanced through use of an economizer to subcool the refrigerant-solvent and increase the net refrigerating effect of the solution. Valve 79 may be operated to regulate or prevent flow through line 27 such that a specified portion or all of the compressed refrigerant passes to condenser-mixer 11.

The compressed gas leaving the compressor 12, via conduit 14, may also be put in heat exchange relation with the refrigerant-solvent stream leaving mixer 11 to subcool the latter if the operating temperature of the mixer 11 is above that of the compressed gas in conduit 14. Thus, as shown in FIG. 1, valves 81 and 83, which are normally closed, may be opened such that compressed refrigerant passes via line 82 to heat exchanger 85 where it exchanges heat with the solvent-refrigerant stream passing through line 15. The compressed refrigerant then passes via line 84 to mixer 11 as already described.

In a presently preferred embodiment, there may be provided a chemically assisted mechanical refrigeration process including several steps. The refrigerant and solvent have a negative deviation from Raoult's, Law when in combination. A stream of solution including a solvent and a liquified refrigerant is passed to an evaporator. The pressure is then reduced over the solution to allow refrigerant to vaporize and separate from the solvent while concurrently therewith the evolving refrigerant and solvent are put in heat exchange relation with a working medium to remove energy from the working medium and thereby form a solvent stream and a refrigerant stream leaving the evaporator. The refrigerant stream includes gaseous refrigerant. The solvent stream leaving the evaporator is then passed in heat exchange relation with the solution stream passing to the evaporator in an economizing zone so as to cause transfer of heat between the solvent stream and the solution. Concurrently therewith, the solvent and refrigerant streams are put in fluid communication with each other so as to accomplish mass transfer of gaseous refrigerant from the solvent stream to the refrigerant stream and so facilitate heat transfer in the economizing zone between the solvent and solution streams. The solvent and refrigerant streams are subsequently contacted in a joint compression zone where the pressure over both streams is raised to form a combined solvent-refrigerant stream. The combined solvent-refrigerant stream is then passed to a mixer under a pressure sufficient to promote substantial dissolving of the refrigerant in the solvent to form the stream of solution for passage to the evaporator. As the mixer is in heat exchange relation with a working medium, energy is removed from the mixer.

Figure 4:
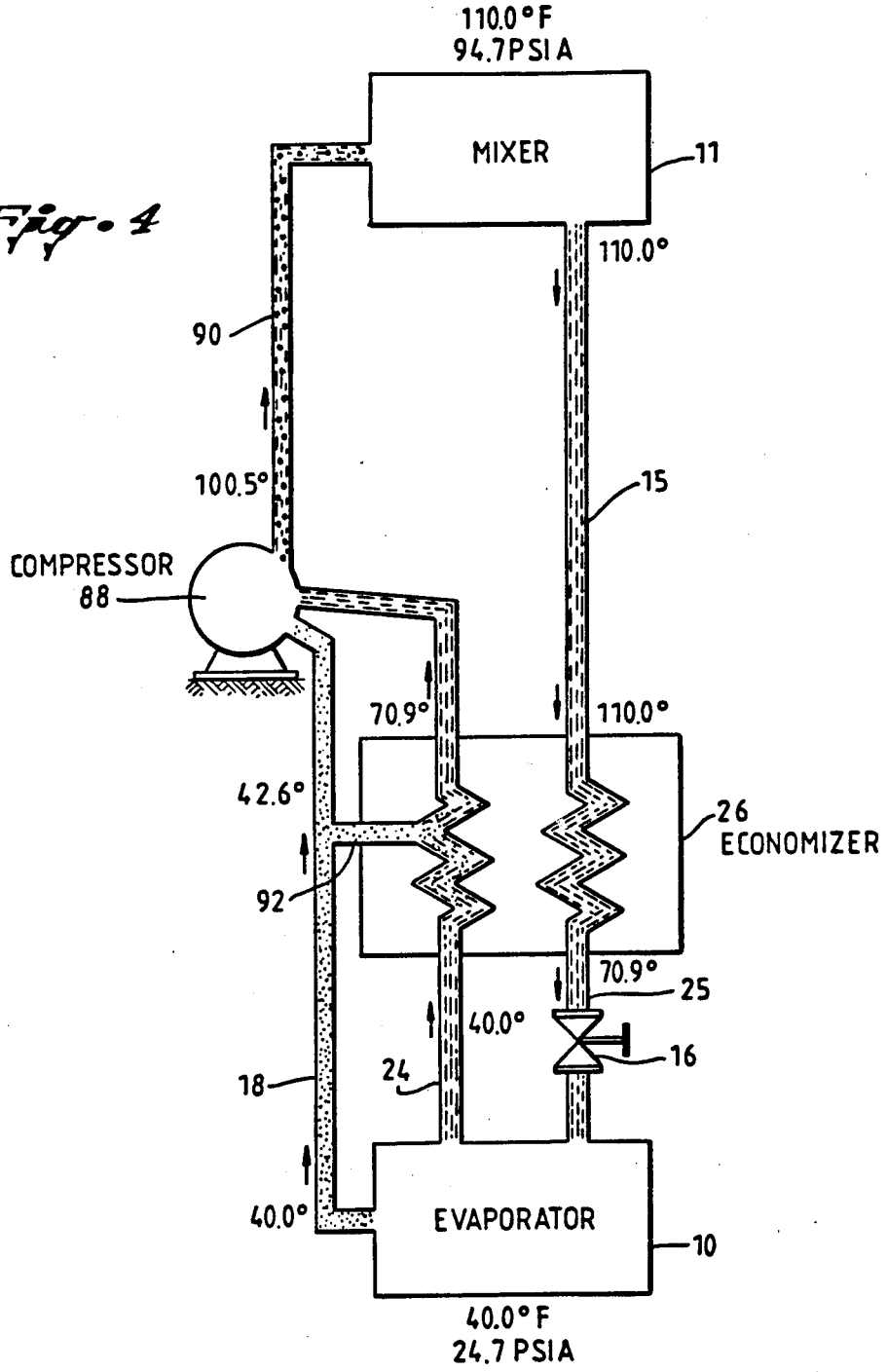
FIG. 4 is a schematic view of yet another embodiment of the present invention.

Turning now to FIG. 4, there will be described a more specific embodiment of a presently preferred embodiment. A solvent-liquified refrigerant stream is passed via line 25 to evaporator 10. The refrigerant and solvent of the solvent-liquified refrigerant stream have a negative deviation from Raoult's Law and may be chosen from a number of combinations of substances already described. By way of example, a refrigerant-solvent combination of $R_{22}$-trichloroethane might be employed.

As essentially discussed in conjunction with the embodiments shown in FIGS. 1 and 2, the pressure over the solvent-refrigerant stream is reduced in the evaporator in order to allow refrigerant to vaporize and separate from the solvent while concurrently placing the evolving refrigerant and solvent in heat exchange relation with the working medium to remove energy from the working medium. As a result, there is formed a solvent stream which passes via line 24 and the refrigerant stream including gaseous refrigerant which passes via line 18.

It is believed that the solvent stream passing via line 24 may contain a material portion of refrigerant without hindering the efficiency of the process. More particularly, the solvent stream leaving the evaporator and passing via line 24 is placed in heat exchange relation with the solvent-refrigerant stream passing to the evaporator via lines 15 and 25. Further, the solvent stream in line 24 is placed in fluid communication with the refrigerant stream of line 18 such that gaseous refrigerant evolving from the solvent stream 24 may pass via conduit 92 to refrigerant stream 18. This evolution of gas tends to cool the solvent stream, thus facilitating heat transfer in the economizer or economizing zone, which in turn increases the temperature drop in the solvent-refrigerant stream as it passes through the economizing zone. Put another way, any inefficiencies in the evaporator caused by a failure of the refrigerant to separate from the solvent are believed diminished since the refrigerant is allowed to further evolve from the solvent and the resulting change in energy is transferred indirectly to the working medium passing through the evaporator by virtue of the lowering of temperature of the solvent-refrigerant stream as it enters the evaporator.

Both the solvent stream and the refrigerant stream are then brought into contact in a joint compression zone as illustrated by compressor 88 in FIG. 4. The compression of the refrigerant gas along with the liquid solvent in a joint compression zone such as compressor 88 is believed to provide several advantages. The liquid solvent would generally have a higher heat capacity than the refrigerant and generally act as a coolant in the compressor, thus reducing the amount of work required to compress the refrigerant. Additionally, a liquid solvent may be chosen which acts both as a sealant and lubricant as well as a coolant. Thus, when a refrigerant gas is compressed and the solvent pumped simultaneously by a single compressor-pump, such as compressor 88 in the joint compression zone, several advantages can accrue. For example, the solvent provides internal cooling of the overall apparatus, thus permitting compression which is more polytropic than isentropic and hence generally more economical. Additionally, it is believed that the presence of the solvent in the compressor permits higher pressures in the case of a centrifugal compressor, or serves as a lubricant and sealant in case of a rotary compressor.

The resulting combined solvent-refrigerant stream flows via line 90 into mixer 11. As already substantially described with respect to FIGS. 1 and 2, in the mixer 11 the combined solvent-refrigerant stream is maintained at a pressure sufficient for the given temperature to promote substantial dissolving of the refrigerant in the solvent to form the stream of solution for passage to the evaporator 10 via lines 15 and 25. Concurrently therewith, the mixer is in heat exchange relation with a working medium which removes energy or heat given off by the dissolving and condensing refrigerant in the mixer 11.

The operation of the embodiment shown in FIG. 4 is further highlighted by the various temperatures shown in the drawing, all of which are in degrees Farenheit. These temperatures were calculated based on the following presumptions. It is presumed that a cycle using $R_{22}$ as a refrigerant and 1,1,1-trichloroethane (TCE) as a solvent was employed with an evaporator temperature of 40° F. (4.44° C.) and a mixer temperature of 110° F. (43.33° C.). Based on the resulting calculations from heat balances, it is believed that the theoretical coefficient of performance of the system would be 6.71, which compares favorably with 5.75 for a pure $R_{22}$ vapor compression cycle generally used in prior art systems. (The theoretical maximum coefficient of performance for a perfect (Carnot) cycle is 7.14.)

Various data necessary to the calculations, vapor densities, discharge temperatures of isentropic compression to determine polytropic discharge temperatures and so forth were taken from American Society of Heating, Refrigerating and Air Conditioning Engineers, *Thermophysical Properties of Refrigerants,* 1976, and American Society of Heating, Refrigerating and Air Conditioning Engineers, *Thermodynamic Properties of Refrigerants,* 1980. Where extrapolations had been made, it is believed that they were generally made in the direction of conservative estimates with respect to cycle performance.

Based on one pound of circulating mass, an $R_{22}$-TCE cycle with an evaporator temperature of 40° F., (4.44° C.) and a mixer temperature of 110° F. (43.33° C.), at 110° F. (43.33° C.) and 94.7 psia (652.93 kPa absolute), 0.684 lbs. of TCE is in equilibrium in a liquid solution with 0.316 lbs. (0.143 kg) of $R_{22}$. At 40° F. (4.44° C.) and 24.7 psia, (170.30 kPa absolute) 0.262 lbs. (0.119 kg) of $R_{22}$ vaporizes, leaving 0.054 lbs. (0.024 kg) of $R_{22}$ remaining in solution. Enthalpy measurements indicate the evolving $R_{22}$ absorbs 22.65 Btu (23.88 k-J) as a gross refrigerating effect in the evaporator.

Assuming perfect heat exchange and equal exit temperatures of 69.6° F. (20.89° C.), the remaining 0.54 lbs. (0.024 kg) of $R_{22}$ should vaporize in the economizer as the solvent entering in at 40° F. (4.44° C.) flows countercurrent to the incoming refrigerant laden solution streams in lines 15 and 25. The exit temperature is approximately 71° F. (21.11° C.).

The 0.684 lbs. (0.310 kg) of TCE, with a specific heat of 0.258, enters the compressor at 70.93° F. (21.63° C.), and the entering temperature of the 0.316 lbs. (0.163 kg) of $R_{22}$ including warmer than 40° F. (4.44° C.) gas from the economizing zone is calculated as 42.62° F. (5.90° C.). Isentropic compression of the gas alone would give a discharge temperature of 148° F. (64.44° C.), so that the discharge temperature of the liquid and gas is 100.51° F. (38.06° C.). It is believed that the passage of the $R_{22}$ and the TCE through any practical, modern compressor occurs so rapidly that no significant dissolving of the $R_{22}$ in the TCE occurs.

The value of n, the constant of polytropic compression is determined from $$T_1/T_2 = (P_1/P_2)^{\frac{n-1}{n}}$$

where $T_1=502.62°$ R, $T_2=560.51°$ R, $P_1=24.7\times144$ psf and $P_2=94.7\times144$ psf. $n=1.09$.

The work of compression in Btu, $(P_2V_2-P_1V_1)/J(1-n)$, is 2.05 Btu (21.61 kJ) per 0.316 lb (0.143 kg) $R_{22}$ vaporized. $V_1$ and $V_2$ are taken from the superheat tables of [American Society of Heating, Refrigerating and Air Conditioning Engineers, *Thermodynamic Properties of Refrigerants,* 1980]. The density of the stripped TCE leaving the economizer 26 is 83.98 lb/ft$^3$ (1345.22 kg per m$^3$), the pressure head across the 70 psi (482.63 kPa) differential is 120.42 ft. (36.70 m), and the Btu (kJ) of pumping 0.684 lb (0.310 kg) of TCE is 0.106 (0.112). Hence the total work of compressing the gas and pumping the liquid is 2.16 Btu/lb (5.02 J per g) of mixture.

Since the refrigerant-solvent solution, with a specific heat of 0.264 must be subcooled 30.93° (=0.59°), to 40°(4.44°) in the evaporator, the net available refrigerating effect, per pound of gas-liquid circulating mass is 14.48 Btu.

The coefficient of performance of the cycle is thus 6.71. Since the theoretical coefficient of performance of the pure $R_{22}$ cycle at these conditions is 5.75, the embodiment shown in FIG. 4 is believed to represent a 16.7% more efficient process than a comparable vapor compression refrigeration cycle.

Figure 5:
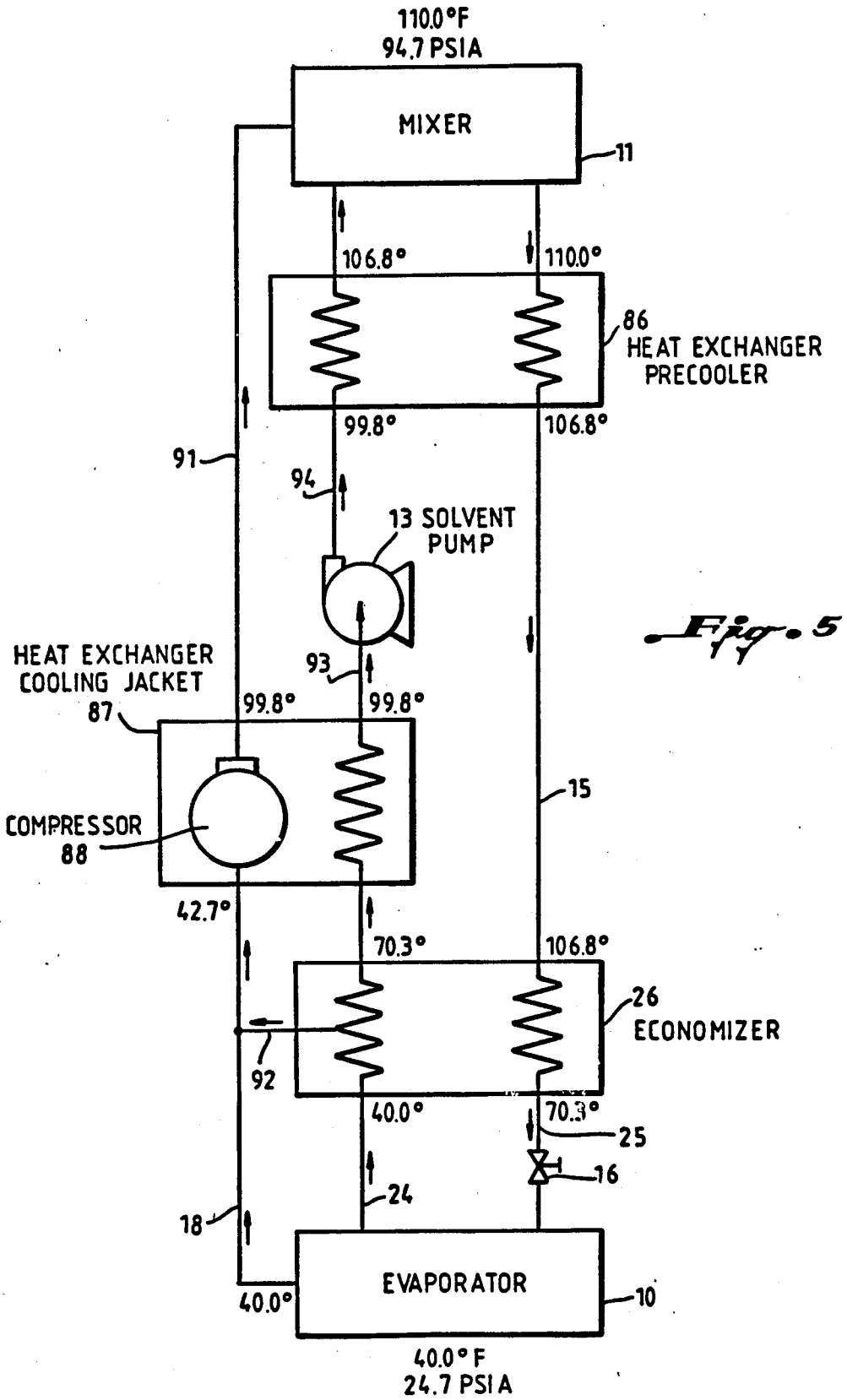
FIG. 5 is a schematic view of yet another embodiment of the present invention.

Schematically diagrammed in FIG. 5 is another embodiment. A solvent-liquid refrigerant stream is passed via line 25 to evaporator 10. As essentially discussed in conjunction with embodiments above, the refrigerant and solvent of the solvent-liquified refrigerant stream exhibit negative deviations from Raoult's Law. Likewise, the pressure over the solvent-liquified refrigerant stream is reduced, by pressure reducing valve 16, to allow refrigerant to vaporize and separate from the solvent in evaporator 10. The evolving mixture is placed, in the evaporator, in heat exchange relation with a working medium from which it removes heat. As a result, there are formed a solvent stream, which passes via line 24, and a refrigerant stream including gaseous refrigerant, which passes via line 18, exiting evaporator 10.

It is believed that the solvent stream passing via line 24 may contain a material portion of refrigerant without hindering efficiency of the process. More particularly, the solvent stream leaving the evaporator 10 and passing via line 24 is placed in heat exchange relation with the solvent-refrigerant stream passing to the evaporator via lines 15 and 25. Further, the solvent stream in line 24 is placed in fluid communication with the refrigerant stream of line 18 such that gaseous refrigerant evolving from the solvent stream 24 may pass via line 92 to refrigerant stream 18. This evolution of gas tends to cool the solvent stream, thus facilitating heat transfer in the economizer or economizing zone 26. This in turn increases the temperature drop, over what might otherwise be expected, in the solvent-liquified refrigerant stream as it passes through the economizing zone, and hence increases the available refrigerating effect in the evaporator.

The refrigerant stream is carried via line 18, as augmented by flow from line 92, to compressor 88. In the compressor, the gaseous refrigerant is pressurized sufficiently to dissolve into the solvent stream in the mixing zone or mixer 11 at the operating temperature of the mixer, while concurrently giving up heats of vaporization and of mixing to a working medium placed in heat exchange relation with the combined refrigerant and solvent streams. The pressurized gaseous refrigerant is passed from compressor 88 via line 91 to mixer 11.

The solvent stream, stripped of a substantial portion of its remaining dissolved refrigerant in the economizer 26, and, having passed that portion of refrigerant mass to the refrigerant stream via line 92, is put in heat exchange relation with the refrigerant gas being compressed in the compressing zone 87. Heat exchange in compressing zone 87 may be accomplished by substantially enclosing compressor 88 in a cooling jacket through which the solvent stream, line 24, flows. It is believed that, by cooling the compression of the gaseous refrigerant with the solvent stream from the economizer, polytropic rather than isentropic compression occurs, resulting in a reduced work of compression and improved cycle efficiency.

From compressing zone 87, the solvent stream passes via line 93 to solvent pump 13 wherein it is raised in pressure to a level as nearly as possible equaling that of the pressurized gaseous refrigerant in line 91.

It is believed that the temperature of the solvent stream exiting the solvent pump in line 94 will generally be less than, or at most equal to, that of the solvent-liquified refrigerant solution in line 15. Hence, the solvent stream in line 94 is put in heat exchange relation, in heat exchanger or precooler 86, with the solvent-liquified refrigerant solution stream of line 15. The purpose of the heat exchange is to subcool the solution stream leaving the mixer 11 and thus to increase the available refrigerating effect in the evaporator.

The compressed gaseous refrigerant stream of line 91 and the pumped solvent stream of line 94 meet and are mixed in mixing zone or mixer 11. The mass of gaseous refrigerant and the mass of liquid solvent combine to form a liquified refrigerant-solvent solution in the mixer. The heats of condensation and of mixing released in the formation of this solution are then transferred to a working medium with which the refrigerant and solvent masses are in heat exchange relation.

The circulating refrigerant-solvent solution then passes in line 15 through heat exchangers 86 and 26, being subcooled at each stage, to pressure-reducing valve 16 and evaporator 10. The flow process is then repeated.

By way of example for this embodiment, a refrigerant-solvent combination of $R_{22}$-trichloroethane (TCE) might be employed. The operation of the embodiment indicated in FIG. 5 is highlighted by the various temperatures shown in the drawing, all of which are in degrees Fahrenheit. It is presumed that a cycle using $R_{22}$ as refrigerant and TCE as a solvent was employed. As in the case of the embodiment pictured in FIG. 4, cycle calculations are based on one pound of circulating mass, with mixer temperature and pressure of 110° F. and 94.7 psia, respectively, and evaporator temperature and pressure of 40° F. and 24.7 psia, respectively.

At mixer conditions, 0.684 lb of TCE is in equilibrium in a liquid solution with 0.316 lb of $R_{22}$. At evaporator conditions, 0.262 lb of $R_{22}$ vaporizes from the original pound of solution. Enthalpy measurements indicate the evolving $R_{22}$ absorbs 22.65 Btu as gross refrigerating effect in the evaporator.

Assuming perfect heat exchange and equal exit temperatures of 72.2° F., substantially all of the remaining 0.054 lb of $R_{22}$ should vaporize in the economizer 26 as the solvent entering at 40.0° flows countercurrent to the incoming refrigerant-laden solution stream in line 15. The exit temperature from economizer 26 is 72.2° F., due in part to the evolution of refrigerant gas from the solvent stream of line 24. The 0.684 lb of TCE, with a specific heat of 0.258, enters heat exchanger-cooling jacket 87 at 70.9° , and the entering temperature of the 0.262 lb of $R_{22}$, including warmer than 40° gas from the economizing zone, is calculated as 42.7° F. Isentropic compression of the gas in compression zone 88 would give a discharge temperature of 148° F., so that the discharge temperature of the polytropically compressed gas in line 91 and heated solvent exiting the cooling jacket in line 93 is 99.8° F. The value of n, the constant of polytropic compression, is determined from:

$$\left(\frac{T_1}{T_2}\right) = \left(\frac{P_1}{P_2}\right)^{\left(\frac{n-1}{n}\right)},$$

where $T_1 = 502.735°$ R, $T_2 = 559.813°$ R, $P_1 = 24.7 \times 144$ psfa and $P_2 = 94.7 \times 144$ psfa, the number $n = 1.087$.

The work of compression in Btu, $(P_2V_2 - P_1V_1)/J(1-n)$, is 2.00 per 0.316 lb of $R_{22}$ vaporized. (Reference values of $V_1$, $V_2$, etc., are as previously cited.)

The density of the stripped TCE leaving economizer 26 is 83.98 lb/ft$^3$, the pressure head across the 70 psi pressure differential is 120.42 ft and the Btu of pumping, via solvent pump 13, the 0.684 lb of TCE is 0.106. Hence the total work of compressing the gas and pumping the liquid is 2 11 Btu/lb of solution.

The 0.684 lb of TCE at 100.5° F. next flows from solvent pump 13, via line 94 to heat exchanger-precooler 86, where it is put in countercurrent heat exchange relation with one pound of solution at 110° F., and having a specific heat of 0.264. The exit temperature of both streams is 106.8° F.

Since the temperature of the refrigerant-solvent solution, in line 15, at the entrance to the economizer has been reduced, a new exit temperature for the solvent stream, line 24, and the solution stream, line 25, is calculated as 70.3° F.

Subcooling to 40° F. at the pressure reducing or throttling valve 16 by vaporizing refrigerant leaves 14.38 Btu per pound of solution as net refrigerating effect in the evaporator 10. The coefficient of performance, 14.38/2.11 is 6.82.

A number of variations and substitutions to the embodiments shown in the drawing are possible. By way of example, it is believed that the embodiment in FIG. 1 may be operated such that a portion of the solvent from line 19 may be sprayed into the refrigerant stream in line 18 and so permit a centrifugal compressor to develop higher pressures, since the pressure developed by a centrifugal pump is proportional to the product of density of the medium being handled and the square of the tip speed. Thus, much greater pressures can be developed for a given centrifugal pump such that a smaller pump may be used.

In another variation on the embodiment shown in FIG. 1, the pump type compressor 12 may be replaced with a jet compressor. Thus, a high velocity liquid jet of solvent supplied to the jet compressor by a portion of the solvent from line 19 may be used to compress the refrigerant gas coming from the evaporator-effervescer 10. The presence of a higher specific heat solvent is believed to result in more efficient compression, due to the greater heat capacity of a liquid. More particularly, the compression becomes more nearly isothermal hence more efficient.

In another embodiment, the compressor 12 and solvent pump 13 may both be replaced by a liquid ring compressor which compresses the refrigerant gas, circulates the solvent and initiates mixing of gas and solvent prior to entry into mixer 11 through a single conduit. Compression is understood to be more nearly isothermal and hence more efficient.

For example, as shown in FIG. 1, valve 76 may be closed off and valve 71 and liquid ring compressor 77 operated such that both solvent and refrigerant pass from evaporator 10 via line 72 to ring compressor 77. The compressed mixture would then pass to mixer 11.

By way of example, the ring compressor 77 might be a double lobe compressor manufactured by Nash Engineering Co. of South Norwalk, Conn. and described in that company's Bulletin No. 474-C dated 1971.

In yet another embodiment, the refrigerant may be foamed with the solvent and solvent pump 13 could be eliminated from the embodiment shown in FIG. 1. Both refrigerant and solvent would be circulated from evaporator 10 to the compressor 12 and hence to mixer 11. Similarly, the embodiment shown in FIG. 2 may also be modified. For example, the solvent pump 13 may be replaced with a device to inject the compressed refrigerant gas from conduit 14 into the solvent stream in conduit 24, thus propelling both refrigerant gas and solvent liquid to condenser-mixer 11. Also, as shown in FIG. 1, valves 71 and 74 may be operated so as to allow at least a portion of solvent to bypass solvent pump 13 while valve 74 is operated to allow a sufficient amount of vapor to pass from line 14 into line 72 via line 73.

The present invention may also be used in conjunction with other systems. For example, a generator-absorber pair might be hooked up in tandem with the compressor to provide a back-up for the same. The generator could function off a secondary source of heat, such as from an exhaust, or a form of solar energy. For example, as shown in FIG. 2, valves 41 and 42 could be placed on both sides of compressor 12 in lines 18 and 14 to hook a generator-absorber pair 48, 44 into the system. A portion of the vaporized refrigerant could then pass from line 18 via line 43 to the absorber, absorbed in an appropriate secondary solvent and then be pumped in solution by pump 46 through lines 45 and 47 to the generator 48. Upon evaporation of the refrigerant in the generator 48 the now compressed vapor could be passed via line 49, valve 42 and line 14 to the mixer 11, while secondary solvent was returned to the absorber 44, via line 50.

The secondary solvent may be the same as used in the primary system.

Of course, in order to obtain all of the advantages of the present invention, the generator-absorber pair should not be completely substituted for the compressor 12. Rather, the generator-absorber pair and the mechanical compressor are complementary means of generating pressurized refrigerant gas.

Further, with respect to the FIG. 4 embodiment, as would be known to one skilled in the art having the benefit of this disclosure, there exist a number of alternatives for concurrent compression-pumping of the gas and liquid constituents. For example, large multi-stage centrifugal compressors as manufactured by York, frequently are designed to inject liquid refrigerant into the vapor stream as a substitute for flash intercooling between stages. However, in such a case, the liquid flow rate should be as reasonably uniform as possible. Also, helical or rotary screw compressors, such as manufactured by Dunham-Bush may be adapted for use with the chemically assisted mechanical refrigeration system as disclosed herein. However, in the chemically assisted mechanical refrigeration system, the solvent should preferably serve as a coolant, lubricant and sealant. Further, bulky oil separators and oil coolers should be eliminated since the solvent passes on to the mixer with the compressed gas.

For smaller capacities, the Wankel-type compressor, manufactured by Ogura Clutch of Japan, or the rolling piston compressors of Rotorex (Fedders) and Mitsubishi may prove useful. Possibly useful also is the multistage centrifugal compressor-pump of the type manufactured by Sihi. In this device, a gas-liquid mixture enters a first, closed impeller axially and the denser liquid is thrown to the periphery. The lighter gas is ported off to the second and subsequent stages nearer the center of the chamber and both gas and liquid are then carried together through second and subsequent impeller stages.

Alternately, where an economizer is used and where capital costs permit, a turbine may be installed in the refrigerant-solvent stream between the economizer and evaporator to function as a pressure reducing device, supplementing throttling devices. Under appropriate operating conditions, it is believed that a subcooled stream exiting the economizer is least likely to flash refrigerant gas at this point and the resultant shaft work may be used to power booster pumps, compressors for the system, auxiliary fans or the like.

Additional items of equipment may be employed within the framework of the present invention. For example, control of the system as well as system versatility may be enhanced through the use of appropriate process controls, though the use of essentially manual control devices may suffice for many operations. Additionally, in the embodiment shown in FIG. 4, a low pressure drop mixing of gaseous refrigerant and liquid could be achieved by using an inline motionless mixer such as one offered by the Mixing Equipment Co., Inc. of Avon, New York.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the size, shape and arrangement of parts. For example, equivalent elements or materials may be substituted for those illustrated and described herein, parts may be reversed, and certain features of the invention may be utilized independently of the use of other features. All this would be apparent to one skilled in the art after having the benefit of this description of the invention.

What is claimed is:

1. A chemically assisted mechanical refrigeration apparatus comprising:

an evaporator for receiving a refrigerant-solvent solution at a pressure sufficient to allow the refrigerant to evolve from the solvent and absorb a substantial portion of the heats of vaporization and dissolution of the refrigerant-solvent solution from a working medium in heat exchange relation with the evolving refrigerant-solvent solution;

a compressor adapted to accept a gaseous stream and a liquid stream and raise the pressure of said streams upon combination of the streams;

a gas-evolving solvent conduit connected at one end to the evaporator and at the other end to the compressor for passing gas-evolving solvent from the evaporator to the compressor;

a refrigerant conduit connected at one end to the evaporator and at the other end to the compressor for passing a gaseous refrigerant from the evaporator to the compressor, said refrigerant conduit being in fluid communication with the solvent conduit for receiving gases evolving from the solvent passing through the solvent conduit;

a mixer configured to receive solvent and refrigerant at a pressure sufficient to promote substantial solution of the refrigerant in the solvent and form a solution;

a combined solvent-refrigerant conduit connected at one end to the compressor and at the other end to the mixer, said conduit being configured to allow passage of a combined refrigerant solvent stream under pressure;

a solution conduit having one end connected to the mixer and the other end connected to the evaporator, said solution conduit being adapted to facilitate any reduction in pressure between the mixer and the evaporator; and an economizer for placing the gas-evolving solvent conduit and the solution conduit in heat exchange relation with each other.

2. The apparatus according to claim 1 further comprising a second heat exchanger for placing the solution conduit and the combined solvent-refrigerant conduit in heat exchange relation with each other.

3. The apparatus of claim 1 wherein the compressor is a centrifugal or rotary compressor.

4. A chemically assisted mechanical refrigeration apparatus comprising:

an evaporator for receiving a refrigerant-solvent solution at a pressure sufficient to allow the refrigerant to evolve from the solvent and absorb a substantial portion of the heats of vaporization and dissolution of the refrigerant-solvent solution from a working medium in heat exchange relation with the evolving refrigerant-solvent solution;

a compressor adapted to accept a gaseous stream and raise the pressure of said stream;

a mixer configured to receive solvent and refrigerant at a pressure sufficient to promote substantial solution of the refrigerant in the solvent and form a solution;

a gas-evolving solvent conduit connected at one end to the evaporator and at the other end to the mixer for passing gas-evolving solvent from the evaporator to the mixer;

a heat exchanger cooling jacket means for placing the compressor and the solvent conduit in heat exchange relation with each other;

a refrigerant conduit connected at one end to the evaporator and at the other end to the compressor for passing gaseous refrigerant from the evaporator to the compressor, said refrigerant conduit being in fluid communication with the solvent conduit at a first point in the solvent conduit, for receiving gases evolving from the solvent passing through the solvent conduit;

pump means located in the solvent conduit between the first point and the mixer for pumping solvent from the evaporator to the mixer;

a solution conduit having one end connected to the mixer and the other end connected to the evaporator, said solution conduit being adapted to facilitate any reduction in pressure between the mixer and the evaporator; and an economizer for placing the gas-evolving solvent conduit and the solution conduit in heat exchange relation with each other.

5. The apparatus of claim 4 further comprising a heat exchanger precooler means for placing the solution conduit in heat exchange relation with the solvent conduit at a second point in the solvent conduit between the heat exchanger cooling jacket and the mixer.

6. The apparatus of claim 4 or claim 5 wherein the pump means is located between the heat exchanger cooling jacket means and the heat exchanger precooler means.

7. The apparatus of claim 4 or claim 5 wherein the pump means is located between the first point and the heat exchanger cooling jacket means.

8. A chemically assisted mechanical refrigeration apparatus comprising:

a mechanical compressor for compressing refrigerant vapors;

a mixing zone configured to receive a solvent for the refrigerant and the compressed refrigerant at a pressure sufficient to promote substantial solution of the refrigerant in the solvent and form a refrigerant-solvent stream;

an evaporator zone for receiving the refrigerant-solvent stream from the mixing zone and evolving the refrigerant as vapors from the refrigerant-solvent stream;

a first conduit interconnecting the mixing zone and the evaporator zone to pass the refrigerant-solvent stream from the mixing zone to the evaporator zone;

a first heat exchanger in the evaporator zone adapted to place at least a substantial portion of the evolving refrigerant-solvent stream in heat exchange relation with a working medium and absorb heats of vaporization and dissolution from the working medium;

a second conduit interconnecting the evaporator zone and the mixing zone to pass refrigerant vapor-evolving solvent from the evaporator zone to the mixing zone;

a second heat exchanger for placing refrigerant vapor-evolving solvent passing in the second conduit from the evaporator zone to the mixing zone in heat exchange relation with the refrigerant-solvent stream passing in the first conduit from the mixing zone to the evaporator zone; and a third conduit interconnecting the evaporator and the compressor to pass evolved refrigerant vapors from the evaporator zone to the compressor.

* * * * *